US007902720B2

(12) United States Patent
Ishikawa et al.

(10) Patent No.: US 7,902,720 B2
(45) Date of Patent: Mar. 8, 2011

(54) HIGH-VOLTAGE DRIVER AND PIEZOELECTRIC PUMP WITH BUILT-IN DRIVER

(75) Inventors: Jun Ishikawa, Tokyo (JP); Yasuyuki Hattori, Tokyo (JP); Akira Sato, Tokyo (JP); Hiromichi Tokuhiro, Tokyo (JP); Masashi Tanabe, Gunma (JP)

(73) Assignees: Sanyo Electric Co., Ltd., Osaka (JP); Sanyo Semiconductor Co., Ltd., Gunma (JP)

( * ) Notice: Subject to any disclaimer, the term of this patent is extended or adjusted under 35 U.S.C. 154(b) by 428 days.

(21) Appl. No.: 12/167,035

(22) Filed: Jul. 2, 2008

(65) Prior Publication Data

US 2009/0060762 A1 Mar. 5, 2009

(30) Foreign Application Priority Data

Jul. 4, 2007 (JP) ..... 2007-175905

(51) Int. Cl.
*H01L 41/09* (2006.01)
*H01L 41/053* (2006.01)
*H02N 2/00* (2006.01)

(52) U.S. Cl. ..... 310/317; 310/328; 310/348

(58) Field of Classification Search ..... 310/317, 310/328, 348

See application file for complete search history.

(56) References Cited

U.S. PATENT DOCUMENTS 5,578,888 A * 11/1996 Safabakhsh ..... 310/328
2006/0186757 A1* 8/2006 Pletner et al. ..... 310/317

FOREIGN PATENT DOCUMENTS

JP 6-109068 4/1994
JP 8-205563 8/1996
JP 2000-60847 2/2000

OTHER PUBLICATIONS esp@cenet patent abstract for Japanese Publication No. 6109068, Publication date Apr. 19, 1994 (1 page).
esp@cenet patent abstract for Japanese Publication No. 8205563, Publication date Aug. 9, 1996 (1 page).
esp@cenet patent abstract for Japanese Publication No. 2000060847, Publication date Feb. 29, 2000 (1 page).

* cited by examiner

*Primary Examiner* — Thomas M Dougherty
(74) *Attorney, Agent, or Firm* — Osha • Liang LLP

(57) ABSTRACT

A digital waveform generating circuit having a DC voltage as an input and generating a sinusoidal digital signal, an active filter extracting low-frequency components from the sinusoidal digital signal generated in the digital waveform generating circuit, and a high-voltage control circuit generating a high-voltage drive signal using the sinusoidal digital signal after passing through the active filter are provided. A smooth waveform without steep voltage changes is generated.

8 Claims, 9 Drawing Sheets

HIGH-VOLTAGE DRIVER AND PIEZOELECTRIC PUMP WITH BUILT-IN DRIVER

BACKGROUND

1. Technical Field

The present invention relates to a high-voltage driver, and a piezoelectric pump unit incorporating a piezoelectric pump and its control board in the same housing.

2. Related Art

A piezoelectric pump has a variable volume chamber (liquid pump chamber) formed between a flat piezoelectric vibrator and a housing, and causes the piezoelectric vibrator to vibrate to thereby change the volume of the variable volume chamber and achieve the pumping action. More specifically, in a pair of paths connected to the variable volume chamber, a pair of check valves for different flow directions (a check valve which allows fluid flow into the variable volume chamber and a check valve which allows fluid flow from the variable volume chamber) are provided, respectively, and, when the volume of the volume variable chamber is changed by the vibration of the piezoelectric vibrator, the operation of opening one of the pair of check valves and closing the other is repeated, thereby achieving the pumping action. Because such a piezoelectric pump is used as a cooling water circulating pump for, for example, a water-cooled notebook computer, reducing the size and the thickness of the pump becomes a key issue.

[Patent Document 1] JP 6-109068 A

[Patent Document 2] JP 8-205563 A

[Patent Document 3] JP 2000-60847 A

In order to reduce the size of the piezoelectric pump, it is advantageous to contain the piezoelectric vibrator and a control board (driver) feeding this piezoelectric vibrator with a drive signal in the same housing. Further, as the control board of the piezoelectric pump generates high voltage, in terms of obtaining UL (Underwriters Laboratories Inc.) approval as well, it is essential to contain the control board in the housing. However, with a conventional control board, drive control parts for a piezoelectric vibrator, such as a waveform generating circuit generating a sinusoidal signal for drive control use, a booster circuit boosting an input signal from a power supply, and a high-voltage control circuit feeding the piezoelectric vibrator with a high-voltage drive signal obtained by synthesizing the boosted voltage signal and the sinusoidal signal, are composed of analog circuits. Therefore, the circuit scale is too large to be contained in the housing. JP 8-205563 A discloses the use of a transmitter composed of such analog circuits, as a reference pulse transmitter. In contrast to this, when the drive control parts on the control board are composed of digital circuits, although their smaller circuit scale enables a smaller and thinner control board, a sinusoidal signal for drive control use is generated by a digital waveform, and therefore, a steep voltage change occurs locally, resulting in a non ideal sinusoidal wave (see FIG. 8C). When a high-voltage drive signal obtained by synthesizing this non smooth sinusoidal digital signal and the boosted voltage signal is fed to the piezoelectric vibrator, the piezoelectric vibrator responds to the steep voltage change of the high-voltage drive signal, resulting in noise generation. Although, in order to remove the steep voltage change of the sinusoidal digital signal, it is possible to enhance the resolution of the time axis and the voltage axis when generating the sinusoidal digital signal, this is not realistic because the circuit scale becomes enormous in order to achieve such resolution. Further, although JP 6-109068 A and JP 2000-60847 A disclose configurations that use a digital/analog converter to generate signals for a piezoelectric actuator and a piezoelectric ceramic plate simply in order to cancel vibration of an engine of an automobile and external environmental noise, such configurations are used merely to cancel vibration and noise in large-size apparatuses like an automobile and a bioacoustic detecting apparatus, and these patent documents fail to recognize the problems to be overcome when a small-size electronic device is to be used by integrating into a piezoelectric pump that constantly causes a diaphragm to vibrate.

SUMMARY

The inventors focused on the fact that a smaller and thinner control board can be achieved by configuring the electric drive control parts for the piezoelectric vibrator with the digital circuits, the fact that high-frequency components of the sinusoidal digital signal (steep voltage change portions) cause noise, and the fact that noise can be reduced by removing these high-frequency components and bringing the sinusoidal digital signal closer to an ideal sinusoidal signal.

A high-voltage driver according to an aspect of the present invention has a digital waveform generating circuit that has a DC voltage signal as an input and generates a sinusoidal digital signal, an active filter that extracts only low frequency components from the sinusoidal digital signal generated in the digital waveform generating circuit, and a high-voltage control circuit that employs the sinusoidal digital signal after passing through the active filter and generates a high-voltage drive signal.

A piezoelectric pump with an integrated driver according to another aspect of the present invention contains, in a single housing, a piezoelectric vibrator and a control board on which drive control parts for the piezoelectric vibrator are mounted, forms a liquid pump chamber on at least one of front and rear faces of the piezoelectric element, and causes the piezoelectric vibrator to vibrate to supply and exhaust a liquid to and from the liquid pump chamber to thereby conduct the pump action. On the control board, a digital waveform generating circuit generating a sinusoidal digital signal for drive control use, an active filter extracting only low-frequency components from the sinusoidal digital signal generated in the digital waveform generating circuit, and a high-voltage control circuit generating a high-voltage drive signal using the sinusoidal digital signal after passing through the active filter and feeding the high-voltage drive signal to the piezoelectric vibrator, are provided.

The high-voltage driver can generate a smooth signal waveform without step-like steep voltage changes. In addition, the piezoelectric pump with the integrated driver can reduce noise during the pump operation, and also downsizing can be achieved.

BRIEF DESCRIPTION THE DRAWINGS

Figure 6:
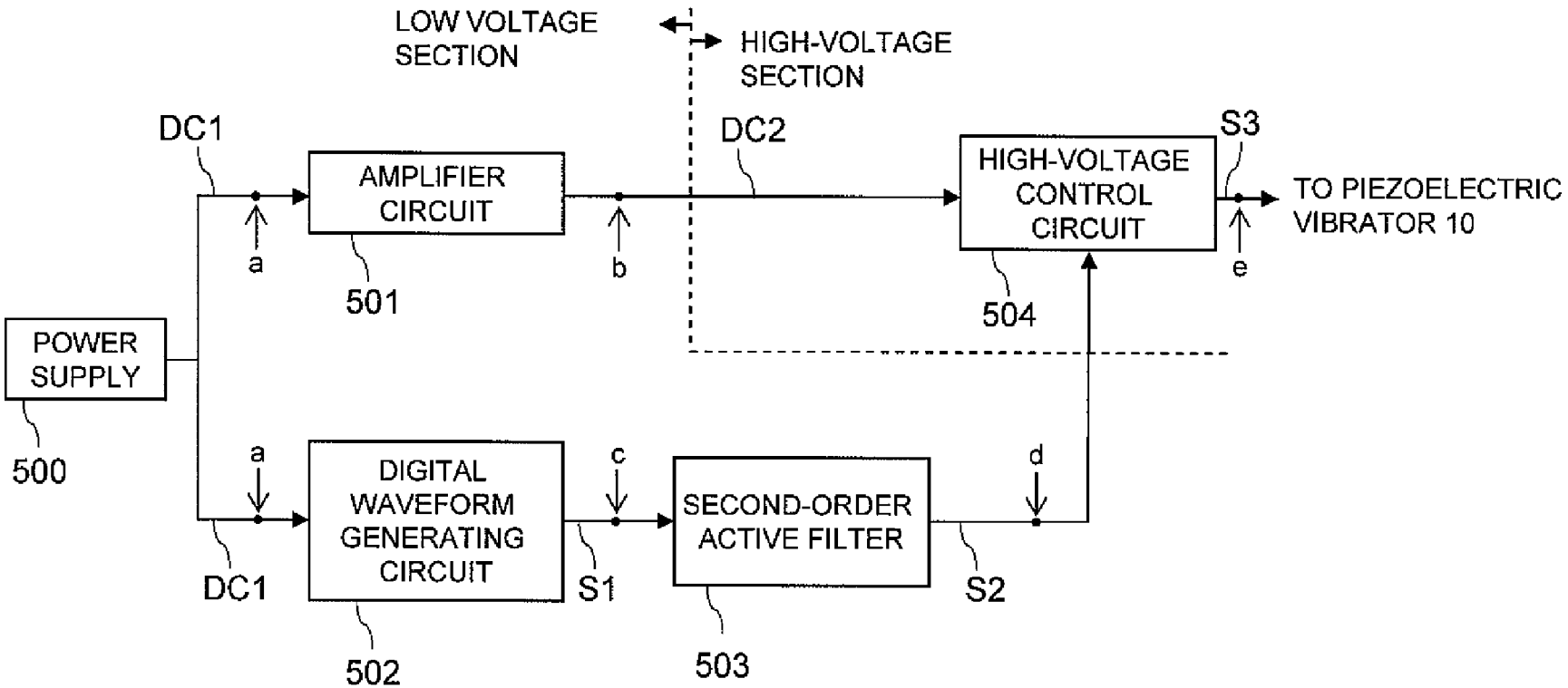
FIG. 6 is a block diagram explaining a drive control system of the piezoelectric pump.
Figure 8A:
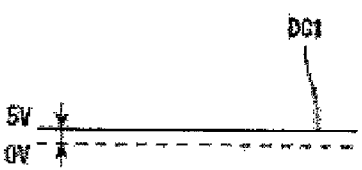
Figure 8B:
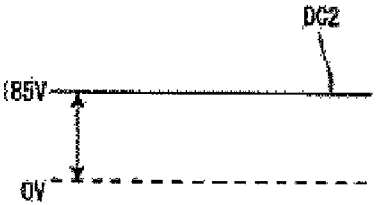
Figure 8C:
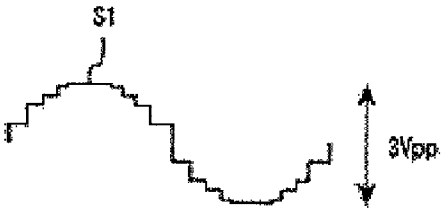
Figure 8D:
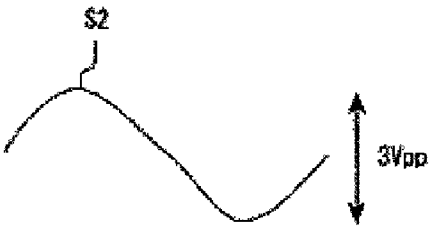
Figure 8E:
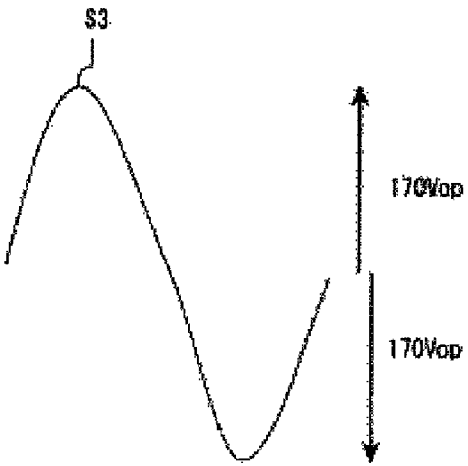
Figure 9:
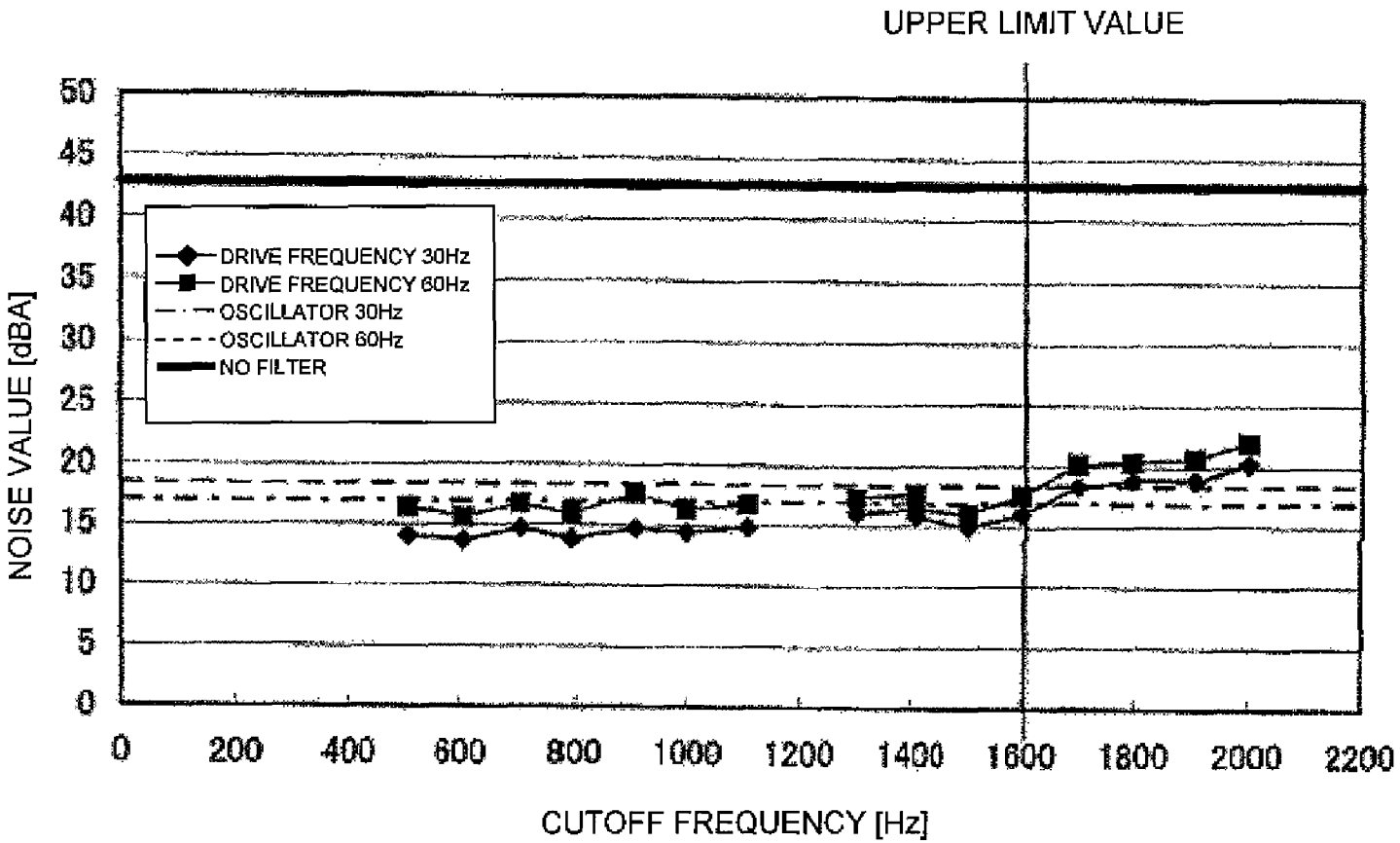

FIGS. 8A, 8B, 8C, 8D, and 8E show signal waveforms at points a-e in FIG. 6, respectively; and FIG. 9 is a graph showing a relationship between a drive frequency and a noise value of the piezoelectric pump.

LIST OF REFERENCE NUMERALS

100 piezoelectric pump, 10 piezoelectric vibrator, 14 first electric supply line, 15 second electric supply line, 18 conductive rubber member, 20 housing, 20A upper cover, 20B main housing, 20C lower cover, 41 circular recessed portion, 45 and 46 electric supply line-containing grooves, 50 drive board, 51 board-containing recessed portion, 52 large cutout, 53 electronic circuit parts, 54 external communication passages, 500 power supply, 501 booster circuit, 502 digital waveform generating circuit, 503 second-order active filter, 504 high-voltage control circuit, A air chamber, DC1 DC voltage signal (low-voltage signal), DC2 DC voltage signal (high-voltage signal), P liquid pump chamber, S1 sinusoidal digital signal, S2 sinusoidal digital signal (low frequency components only), S3 high-voltage drive signal.

DESCRIPTION OF THE EMBODIMENTS

FIG. 1 through FIG. 6 show the entire configuration of a piezoelectric pump 100 according to an embodiment of the present invention. This piezoelectric pump 100 includes a piezoelectric vibrator 10, a housing 20, and a drive board 50. The housing 20 is composed of an upper cover (upper housing) 20A, a main housing 20B, and a lower cover (lower housing) 20C, and, in the main housing B, a circular recessed portion 41 having an opening to the upper housing 20A side is formed (see FIG. 3 and FIG. 5), and a board-containing recessed portion 51 having an opening to the lower housing 20C side is formed (see FIG. 4 and FIG. 5). Around the circumference of the circular recessed portion 41, an o-ring containing annular groove 41*a*is formed concentrically.

Figure 1:
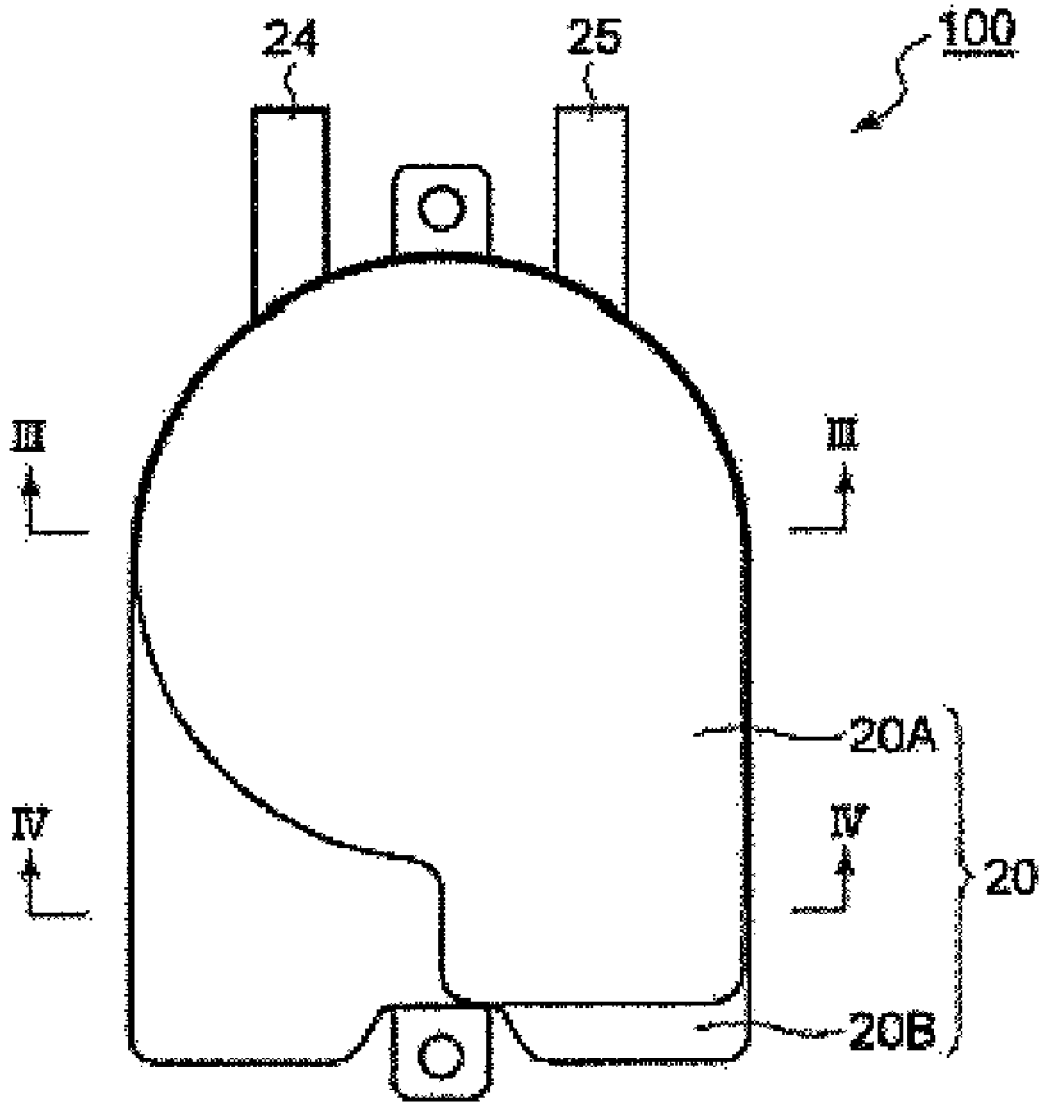
FIG. 1 is a plane view showing a piezoelectric pump according to an embodiment of the invention.
Figure 2:
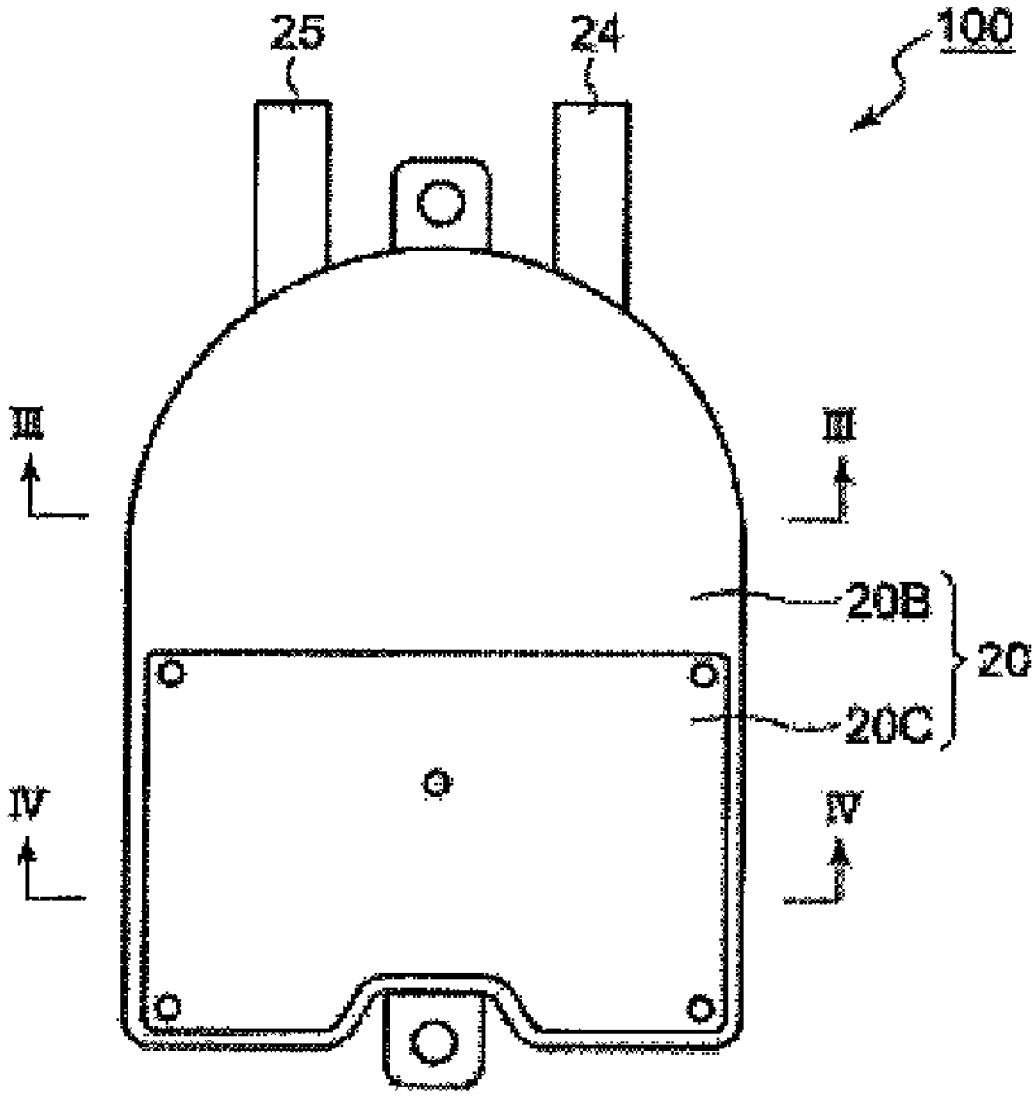
FIG. 2 is a back view showing the piezoelectric pump.
Figure 3:
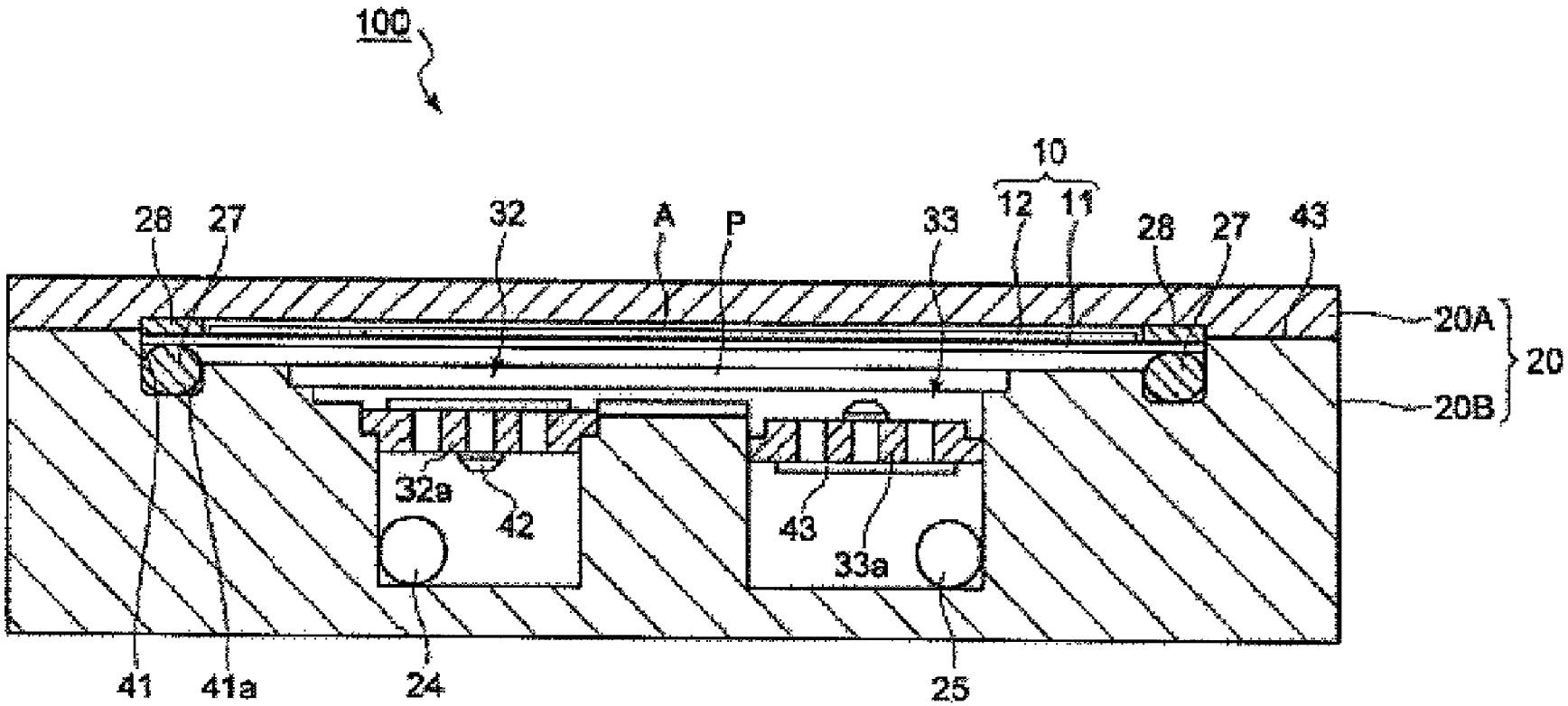
FIG. 3 is a cross section taken along line III-III of FIG. 1 and FIG. 2.
Figure 5:
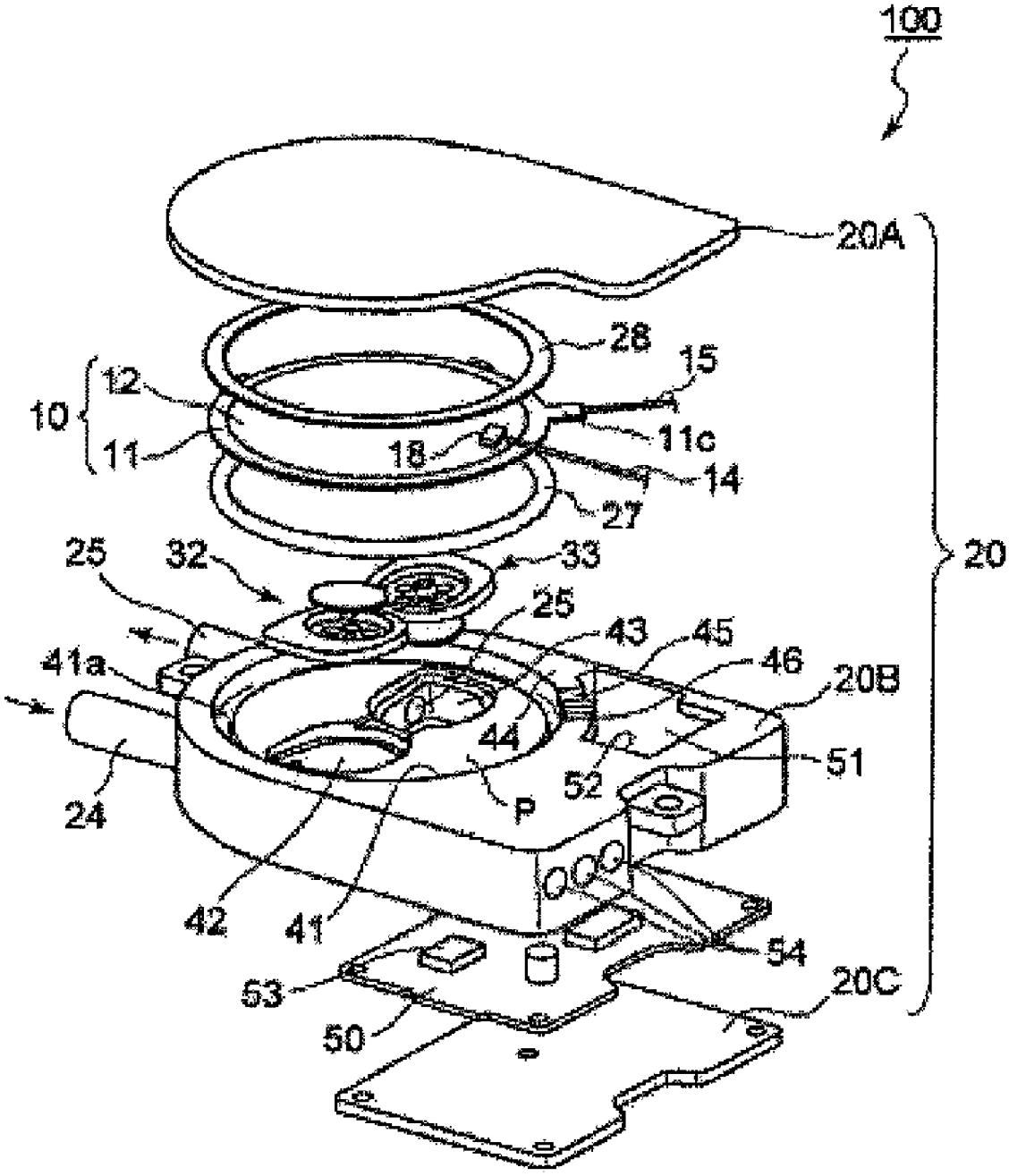
FIG. 5 is an exploded perspective view of the piezoelectric pump.

As shown in FIG. 3 and FIG. 5, the piezoelectric vibrator 10 has a circular metal shim 11 and a circular piezoelectric body 12 formed on one of the front and back faces of this shim 11. In this embodiment, the shim 11 faces the liquid pump chamber P side, and the piezoelectric body 12 faces the air chamber A side.

The shim 11 is a conductive thin metal plate made of, for example, stainless steel and 42Alloy having a thickness of approximately 30to 300μm, and the piezoelectric body 12 is made of a piezoelectric material such as PZT($Pb(Zr,Ti)O_3$) having a thickness of approximately 50to 300μm, and has been subjected to polarization processing in the front-rear direction thereof. Such a piezoelectric vibrator is well known. When an alternating electric field (high-voltage drive signal) is applied on the front and back of the piezoelectric body 12, the cycle in which one of the front and back of the piezoelectric body 12 expands and the other contracts is repeated to thereby cause the shim 11 (piezoelectric vibrator 10) to vibrate.

As shown in FIG. 5, in the piezoelectric vibrator 10, a first power supply line (lead material) is conductively connected to the circumference of the front face of the piezoelectric body 12 via a conductive rubber member 18. The conductive rubber member 18 is made of a conductive rubber in which rubber property is maintained and a volume resistivity value is made small. Further, a second electric supply line 15 is connected to a wiring connecting projection 11*c* integrally molded so as to project along the radius direction of the shim 11.

The o-ring 27 is inserted in the o-ring containing annular groove 41*a*, and the piezoelectric vibrator 10 is inserted in the circular recessed portion 41 of the main housing 20B. Then, by placing the upper housing 20A on the main housing 20B while providing a circular guide 28 on the circumference of the piezoelectric vibrator 10, the piezoelectric vibrator 10 is tightly supported in between in a fluid-tight manner. The liquid pump chamber P is provided between this piezoelectric vibrator 10 and the circular recessed portion 41, and the air chamber (air pump chamber) A is formed between the piezoelectric vibrator 10 and the upper housing 20A.

In the circular recessed portion 41 of main housing 20B, a suction side liquid-pool chamber 42 and a discharge side liquid-pool chamber 43 are formed and located in positions which are eccentric and symmetric with respect to the plane center of the piezoelectric vibrator 10 (circular recessed portion 41). A suction side check valve 32 and a discharge side check valve 33 are provided between the suction side liquid-pool chamber 42 and the liquid pump chamber P, and between the discharge side liquid-pool chamber 43 and the liquid pump chamber P, respectively. Further, in the main housing 20B, a suction port 24 and a discharge port 25 communicating with these suction side liquid-pool chamber 42 and discharge side liquid-pool chamber 43, respectively, are formed.

The suction side check valve 32 is a suction side check valve that allows fluid flow from the suction port 24 to the liquid pump chamber P and does not allow fluid flow in the reverse direction, and the discharge side check valve 33 is a discharge side check valve that allows fluid flow from the liquid pump chamber P to the discharge port 25 and does not allow fluid flow in the reverse direction.

The check valves 32 and 33 have the same configurations and are formed such that umbrellas made of elastic material are mounted on perforated boards 32*a*and 33*a*bonded to the flow path in a fixed manner, respectively.

Figure 4:
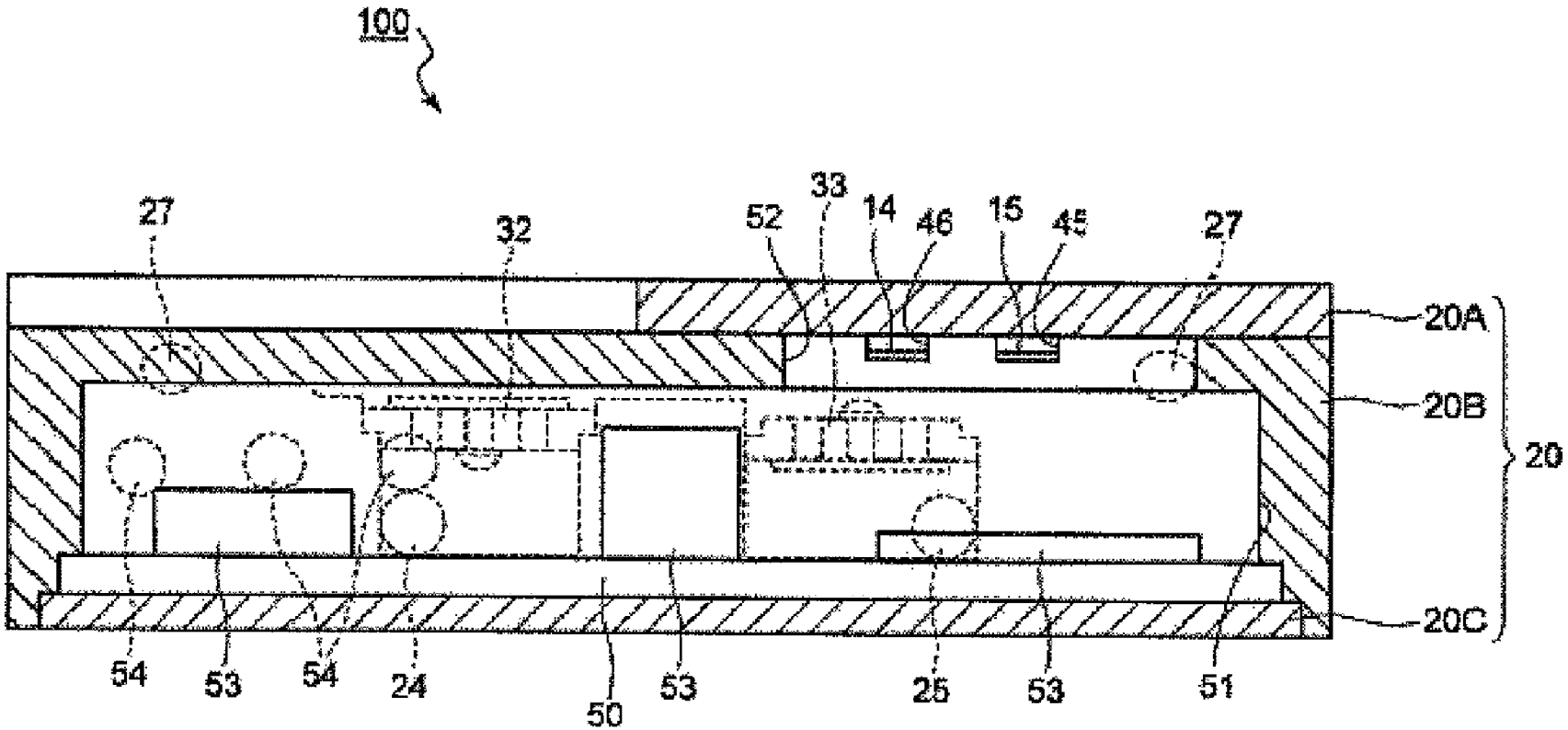
FIG. 4 is a cross section taken along line IV-IV of FIG. 1 and FIG. 2.

In the main housing 20B, electric supply line-containing grooves 45 and 46 are formed in a tubular portion 44 located around the circular recessed portion 41, each indifferent positions along the circumferential direction of the circular recessed portion 41 (FIG. 4 and FIG. 5). The electric supply line-containing grooves 45 and 46 allow the first electric supply line 14 and the second electric supply line 15 to pass therethrough, respectively, and have large cross-sections so that sufficient air circulation spaces are secured even when the first electric supply line 14 and the second electric supply line 15 pass respectively therethrough.

In the main housing 20B, a large cutout (air chamber passage or through hole) 52 allowing the air chamber A and the board-containing recessed portion 51 to communicate with each other through the electric supply line-containing grooves 45 and 46 is formed (FIG. 4 and FIG. 5). As is clear from FIG. 4, the top surface of this large cutout 52 is covered by the upper housing A placed on the main housing 20B.

In the main housing 20B, external communication passages (holes) 54 allowing the board-containing recessed portion 51 to communicate externally are formed. As such, the board-containing recessed portion 51 is in communication with the air chamber A through the large cutout 52 and the electric supply line-containing grooves 45 and 46, and is externally communicated through the external communication passages 54. As such, the air chamber A is externally communicated even when the board-containing recessed portion 51 of the main housing 20B is set with the drive board 50 and is covered by the lower housing 20C. In other words, when the piezoelectric vibrator 10 vibrates to thereby contract the volume of the air chamber A, an outward flow passing through the electric supply line-containing grooves 45 and 46, the large cutout 52, the board-containing recessed portion 51, and the external communication passage 54 is generated, while when the volume of the air chamber A is expanded, an inward flow passing through the external communication passage 54, the board-containing recessed portion 51, the large cutout 52, and the electric supply line-containing grooves 45 and 46 is generated.

On the drive board 50, electronic circuit parts 53 controlling drive of the piezoelectric vibrator 10 (FIG. 4 and FIG. 5) and a printed circuit (not shown) connecting these electronic circuit parts 53 are formed. The first electric supply line 14 and the second electric supply line 15, which are guided outside the air chamber A (circular recessed portion 41) through the electric supply line-containing grooves 45 and 46, are connected to the drive board 50. Heat generation from the electric circuit parts 53 on the drive board 50 is released outside by the outward air flow passing through the electric supply line-containing grooves 45 and 46, the large cutout 52, the board-containing recessed portion 51, and the external communication passage 54, or by the inward air flow passing through the external communication passage 54, the board-containing recessed portion 51, the large cutout 52, and the electric supply line-containing grooves 45 and 46.

Next, referring to FIG. 6 to FIG. 9, drive control of the piezoelectric vibrator 10, which is a feature of the present invention, will be described.

FIG. 6 is a block diagram showing the drive control system (electronic circuit parts 53) of the piezoelectric vibrator 10. This drive control system has a power supply 500, a booster circuit 501, a digital waveform generating circuit 502, a second-order active filter 503, and a high-voltage control circuit 504.

The booster circuit 501 boosts a DC voltage signal (low-voltage signal) DC1 input from the power supply 500 and outputs a DC voltage signal (high-voltage signal) DC2 which is higher than this DC voltage signal DC1 to the high-voltage control circuit 504. In this embodiment, for example, a DC voltage signal DC1 of 5V is boosted to a DC voltage signal DC2 of 200V. Waveforms of the DC voltage signals DC1 and DC2 are shown in FIG. 5A and FIG. 8B, respectively. In FIG. 8, the longitudinal axis represents a voltage and the horizontal axis represents time. This booster circuit 501 may be provided in the high-voltage control circuit 504.

The digital waveform generating circuit 502 inputs the DC voltage signal DC1 from the power supply 500 and generates a sinusoidal digital signal S1 for controlling drive of the piezoelectric vibrator 10. Frequency and amplitude of the sinusoidal digital signal S1 can be set appropriately according to the drive behavior of the piezoelectric vibrator 10. FIG. 8C shows a waveform of the sinusoidal digital signal S1. Because the sinusoidal digital signal S1 has a sinusoidal waveform expressed by discontinuous digital values (voltage values), as shown in FIG. 5C, step-like voltage changes along the time axis, that is, steep voltage changes, occur locally. Although it is possible to bring this sinusoidal digital signal S1 closer to an ideal continuous sinusoidal waveform by enhancing the resolution in the time axis and the voltage axis, there is a limitation due to the configuration of the digital waveform generating circuit 502. For the sinusoidal digital signal S1 in this embodiment, the maximum amplitude (amplitude from a positive peak to a negative peak) Vpp is set to 3V.

Figure 7:
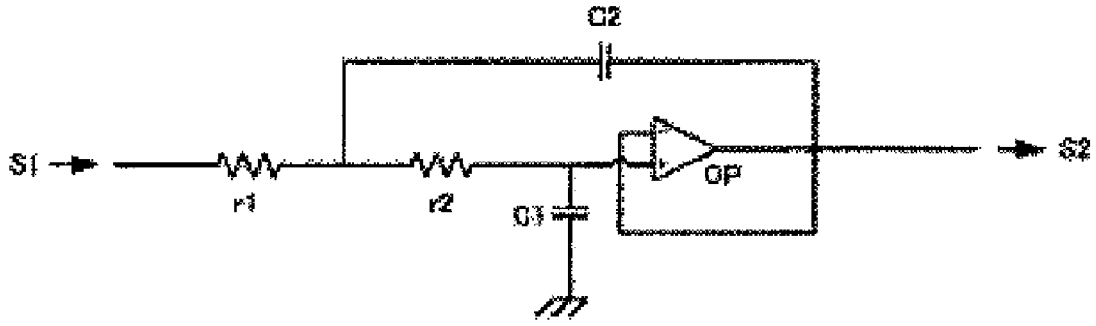
FIG. 7 is a circuit configuration example of a second-order active filter of FIG. 6.

The second-order active filter 503 has, as an input, the sinusoidal digital signal S1 generated in the digital waveform generating circuit 502, cuts off frequency components higher than a predetermined cutoff frequency fc, and extracts only low frequency components equal to or lower than the same cutoff frequency from this sinusoidal digital signal S1. FIG. 8D shows a signal waveform of a sinusoidal digital signal S2 after passing through the second-order active filter 503. The sinusoidal digital signal S2, from which the high frequency components are removed by the second-order active filter 503, has no step-like steep voltage change and has a smooth signal waveform to thereby be closer to an ideal sinusoidal waveform. This sinusoidal digital signal S2 has a maximum amplitude Vpp of 3V, which is the same as that of the sinusoidal digital signal S1 before passing through the second-order active filter 503. FIG. 7 shows a specific circuit configuration of the second-order active filter 503 composed of an op-amp, resisters R1 and R2, and capacitors C1 and C2. In this case, a cutoff frequency Fc of the second-order active filter 503 is determined as follows:

$$f_c = \frac{1}{2\pi\sqrt{C1C2r1r2}}$$

The high-voltage control circuit 504 synthesizes the DC voltage signal DC2 boosted in the booster circuit 501 with the smooth sinusoidal digital signal S2 after passing through the second-order active filter 503, generates a high-voltage drive signal S3 at a level that can drive the piezoelectric vibrator 10, and outputs this high-voltage drive signal S3 to the piezoelectric vibrator 10. FIG. 8E shows a signal waveform of the high-voltage drive signal S3. The high-voltage drive signal S3 has a smooth signal waveform (sinusoidal waveform) without stepwise steep voltage changes, like the sinusoidal digital signal S2. The high-voltage control circuit 504 of this embodiment generates a high-voltage drive signal S3 having an amplitude (amplitude from 0V to one of positive and negative peaks) Vop of 170V.

When the high-voltage drive circuit 504 outputs the high-voltage drive signal S3, the piezoelectric vibrator 10 vibrates (elastically deforms) reciprocally based on the high-voltage drive signal S3. In the piezoelectric pump 100, during the process in which the volume of the liquid pump chamber P is expanded by the vibration of the piezoelectric vibrator 10, the suction side check valve 32 is opened and the discharge side check valve 33 is closed to thereby cause the fluid to flow from the suction port 24 into the liquid pump chamber P, while during the process in which the volume of the liquid pump chamber P is contracted, the discharge side check valve 33 is opened and the suction side check valve 32 is closed to thereby cause the fluid to flow from the liquid pump chamber P to the discharge port 25. In such a manner, the pumping action is achieved. Because, during this pumping action, the high-voltage drive signal S3 has the smoothed signal waveform (sinusoidal waveform) without step-like steep voltage change as described above, the vibrations of the piezoelectric vibrator 10 are repeated smoothly and noise is reduced.

In the above drive control system, the power supply 500, the booster circuit 501, the digital waveform generating circuit 502, and the second-order active filter 503 constitute a low-voltage section for processing a low-voltage signal (DC voltage signal DC1), and the high-voltage control circuit 504 constitutes a high-voltage section for processing the high-voltage signal (DC voltage signal DC2). The second-order active filter 504 may be provided in the high-voltage section. However, when the second-order active filter 504 is provided in the high-voltage section, lower frequency components are extracted from the high-voltage signal boosted in the booster circuit, and the number of filter component parts thus becomes more than when extracting the lower frequency components from the low-voltage signal (sinusoidal digital signal) before being boosted in the booster circuit, resulting in a disadvantage in reducing the size. In addition, the use of heavy high-voltage parts in the filter component parts becomes essential, and this results in increase in cost. It is therefore desirable to provide the second-order active filter 504 in the low-voltage section like the present embodiment. The drive board on which the above drive control system is mounted is formed as small as 20mm×31mm and 4.5mm in thickness. As such, the piezoelectric pump 100 contains the drive board 50 in the housing 20 and achieves a size as small as 20mm×31mm and 4.5mm in thickness.

FIG. 9 shows the result of measuring noise values [dBA] during the pump operation while changing a cutoff frequency fc [Hz] of the second-order active filter 503.

In FIG. 9, the dotted line and the dash-dot line are comparative examples and indicate noise values generated when an oscillator is operated at frequencies of 30Hz and 60Hz, respectively. These noise values are measured by amplifying the outputs of the oscillator using an amplifier. As the oscillator, DF1905 from NF Corporation is employed, and as the amplifier, M-2601 from Mess-Tek Co., Ltd. is employed. The noise values measured by this oscillator are approximately 16.9dBA at a drive frequency of 30 Hz and approximately 18.4dBA at a drive frequency of 60 Hz.

Further, in FIG. 9, the thick solid line (solid line in the horizontal direction in the figure) is a comparative example indicating a noise value generated when the piezoelectric vibrator 10 is vibrated by a conventional drive control system having no second-order active filter 503. Here, driving the piezoelectric vibrator 10 by the conventional drive control system means that the piezoelectric vibrator 10 is driven by a high-voltage drive signal generated using a sinusoidal digital signal S1 output from the digital waveform generating circuit 503. That is, steep voltage changes occur locally in the high-voltage drive signal for driving the piezoelectric vibrator 10 (a state in which high frequency components of the sinusoidal digital signal S1 are included). In this case, a noise value is 42.8dBA.

In FIG. 9, the line charts are examples and show the relationship between cutoff frequencies fc and noise values when the piezoelectric vibrator 10 is vibrated at drive frequencies of 30Hz and 60Hz, respectively, by the drive control system (the power supply 50*o*, the booster (amplifier) circuit 501, the digital waveform generating circuit 502, the second-order active filter 503, and the high-voltage control circuit 504) of the present embodiment.

Referring to FIG. 9, it will be understood that, when the piezoelectric vibrator 10 is driven at either of the drive frequencies 30Hz and 60Hz, the noise value during the pump operation is much lower than when the piezoelectric vibrator is driven by the drive control system having no second-order active filter. As such, it is obvious that noise during the pump operation can be reduced by employing the second-order active filter 503. Referring to FIG. 9 in more detail, it is understood that, when the cutoff frequency fc is lower than 1.6kHz, noise during the pump operation becomes smaller than the noise value by the oscillator, and when the cutoff frequency fc is equal to or greater than 1.6kHz, noise during the pump operation becomes greater than the noise value by the oscillator. This trend is the same both when the piezoelectric vibrator 10 is driven at a drive frequency of 30Hz and when the piezoelectric vibrator 10 is driven at a drive frequency of 60Hz. In the present embodiment, the noise value by the oscillator serves as a reference noise level, and the cutoff frequency fc of the second-order active filter 503 is set so that a noise value during the pump operation does not exceed this reference noise level. In other words, the cutoff frequency fc is set so as to have an upper-limit frequency of 1.6kHz at which a noise value during the pump operation is the same as the reference noise level. It is preferable to set a lower limit cutoff frequency fc to a level that does not influence the drive frequency region of the piezoelectric vibrator 10. Further, although in this example the second-order active filter was employed, it is preferable to employ the first active filter when a difference between a drive frequency of the piezoelectric pump and a frequency of target noise is large and to employ a second- or higher-order active filter when a difference between a drive frequency and a frequency of target noise is small. However, because the circuit scale becomes larger as the order of the active filter is higher, it is preferable to employ an active filter having a lower order.

As described above, because the present embodiment has the second-order active filter 503 which cuts off high frequency components causing noise during the pump operation and extracts low frequency components from non smooth sinusoidal digital signal S1 having steep voltage changes locally, it is possible to generate the high-voltage drive signal S3 having a smooth sinusoidal waveform without steep voltage changes using the sinusoidal digital signal S2 (low frequency components only) after passing through the second-order active filter 503. This high-voltage drive signal S3 then causes the piezoelectric vibrator 10 to vibrate and repeats the vibration of the piezoelectric vibrator 10 smoothly to thereby reduce noise during the pump operation. Because it is possible to reduce noise during the pump operation in such a manner, by containing the control board 50 on which the drive control parts for the piezoelectric vibrator 10 are configured with the digital circuits, and reduced in size and thickness, and the piezoelectric vibrator 10 in the single housing 20, it is possible to thereby achieve a small-sized piezoelectric pump with integrated a driver.

What is claimed is:

1. A high-voltage driver comprising:

a digital waveform generating circuit that has a DC voltage signal as an input and generates a sinusoidal digital signal;

an active filter that extracts only low frequency components from the sinusoidal digital signal generated in the digital waveform generating circuit; and a high-voltage control circuit that employs the sinusoidal digital signal after passing through the active filter and generates a high-voltage drive signal.

2. The high-voltage driver according to claim 1, further comprising a booster circuit that boosts the DC voltage signal and outputs a high-voltage signal, wherein the high-voltage control circuit synthesizes the high-voltage signal and the sinusoidal digital signal and generates the high-voltage drive signal.

3. The high-voltage driver according to claim 2, wherein:

the booster circuit, the digital waveform generating circuit, and the active filter constitute a low-voltage section that processes the DC voltage signal; and the high-voltage control circuit constitutes a high-voltage section that processes the high-voltage signal.

4. The high-voltage driver according to claim 1, wherein:

the high-voltage driver is a control driver for a piezoelectric pump;

the piezoelectric pump contains, in a single housing, a piezoelectric vibrator forming a liquid pump chamber on at least one of front and back faces thereof and a control board on which drive control parts for the piezoelectric vibrator are mounted, and causes the piezoelectric vibrator to vibrate to supply and exhaust a liquid to and from the liquid pump chamber to thereby conduct the pump action; and the high-voltage driver is provided on the control board.

5. A piezoelectric pump with an integrated driver containing, in a single housing, a piezoelectric vibrator and a control board on which drive control parts for the piezoelectric vibrator are mounted, forming a liquid pump chamber on at least one of front and back faces of the piezoelectric vibrator, and causing the piezoelectric vibrator to vibrate to supply and exhaust a liquid to and from the liquid pump chamber to thereby conduct the pump action, the piezoelectric pump comprising:

on the control board, a digital waveform generating circuit that generates a sinusoidal digital signal for drive control use, an active filter that extracts only low-frequency components from the sinusoidal digital signal generated in the digital waveform generating circuit, and a high-voltage control circuit that generates a high-voltage drive signal using the sinusoidal digital signal after passing through the active filter and feeds the high-voltage drive signal to the piezoelectric vibrator.

6. The piezoelectric pump with the integrated driver according to claim 5, wherein:

a booster circuit that boosts an input DC voltage signal is provided on the control board; and the high-voltage control circuit synthesizes the DC voltage signal boosted in the booster circuit and a sinusoidal digital signal after passing through the active filter and generates the high-voltage drive signal.

7. The piezoelectric pump with the integrated driver according to claim 6, wherein the booster circuit, the digital waveform generating circuit, and the active filter constitute a low-voltage section that processes the DC voltage signal before being boosted in the booster, and the high-voltage control circuit constitutes a high-voltage section that processes the DC voltage signal after being boosted in the booster circuit.

8. The piezoelectric pump with the integrated driver according to claim 5, wherein the housing comprises a main housing that has, on its front and back faces, a circular recessed portion containing the piezoelectric vibrator and a board-containing recessed portion containing the control board, respectively, an upper cover that covers the circular recessed portion, and a lower cover that covers the board-containing recessed portion of the main housing.

* * * * *